US009320394B2

(12) United States Patent
Paskman et al.

(10) Patent No.: US 9,320,394 B2
(45) Date of Patent: Apr. 26, 2016

(54) DRAIN DESIGN FOR USE IN A POLYURETHANE COMPOSITE BATHING VESSEL

(75) Inventors: David Stuart Paskman, Gloucester City, NJ (US); Scott Kapelanski, Howell, MI (US); Michael Glenn Geels, Jackson, TN (US)

(73) Assignee: Delta Faucet Company, Indianapolis, IN (US)

( * ) Notice: Subject to any disclaimer, the term of this patent is extended or adjusted under 35 U.S.C. 154(b) by 379 days.

(21) Appl. No.: 13/883,654

(22) PCT Filed: Sep. 2, 2011

(86) PCT No.: PCT/US2011/050356

§ 371 (c)(1),
(2), (4) Date: Aug. 14, 2013

(87) PCT Pub. No.: WO2012/067697

PCT Pub. Date: May 24, 2012

(65) Prior Publication Data

US 2014/0173821 A1 Jun. 26, 2014

Related U.S. Application Data

(60) Provisional application No. 61/413,575, filed on Nov. 15, 2010.

(51) Int. Cl.

| | |
|---|---|
| ***A47K 3/02*** | (2006.01) |
| ***A47K 3/04*** | (2006.01) |
| ***A47K 3/30*** | (2006.01) |
| ***B05D 3/12*** | (2006.01) |
| ***A47K 3/16*** | (2006.01) |

(52) U.S. Cl.

CPC ... *A47K 3/04* (2013.01); *A47K 3/02* (2013.01); *A47K 3/16* (2013.01); *A47K 3/30* (2013.01); *B05D 3/12* (2013.01); *Y10T 29/49* (2015.01); *Y10T 29/49826* (2015.01)

(58) Field of Classification Search

CPC ..... A47K 3/02
USPC ..... 4/538–595
See application file for complete search history.

(56) References Cited

U.S. PATENT DOCUMENTS

| | | | | | |
|---|---|---|---|---|---|
| 5,167,898 | A * | 12/1992 | Luther | ..... | 264/328.1 |
| 5,494,718 | A * | 2/1996 | Adams et al. | ..... | 428/35.7 |
| 2008/0000022 | A1 * | 1/2008 | Sieben | ..... | 4/580 |

OTHER PUBLICATIONS

International Search Report from WO2012/067697.

* cited by examiner

*Primary Examiner* — Lori Baker
(74) *Attorney, Agent, or Firm* — Carlson, Gaskey & Olds, PC

(57) ABSTRACT

A bathing vessel has a bottom, and a drain disposed in the bottom adjacent a blended area that is disposed between the side wall and the bottom. The side wall, the bottom wall, and the blended area are made of a first layer of rigid polyurethane material and a second layer of capping material attached to said first layer. A ratio of a density of the polyurethane backing adjacent the drain to a thickness of polyurethane backing is between 1-80:1. The side wall, the blended area and the bottom wall flex to absorb loads adjacent the drain.

21 Claims, 1 Drawing Sheet

DRAIN DESIGN FOR USE IN A POLYURETHANE COMPOSITE BATHING VESSEL

RELATED APPLICATION

This application claims priority to U.S. Provisional Application No. 61/413,575, which was filed Nov. 15, 2010.

BACKGROUND

Bathtubs, bathtub and shower enclosures, shower stalls, basins, and the like, made of a synthetic resinous material, are known and have become increasingly popular due, among other things, to their light weight, ease of installation, and easy maintenance. One such type of resinous composite-shaped is comprised of a relatively thin gel top coat having a thermoset polyester, a supporting layer underneath the top coat made of a chopped glass fiber-filled or reinforced thermoset polyester, an intermediate layer underneath the supporting layer made of a polyurethane foam containing no reinforcing fibers, and a bottom layer underneath the intermediate layer made of a chopped glass fiber-reinforced thermoset polyester.

While these resinous composite-shaped articles are very useful and satisfactory, they suffer from a difficult manufacturing process used to produce the article. This composite article is made by first depositing the gel top coat layer on the outer surface of a mold, then depositing the supporting layer onto the gel coat layer, followed by depositing the intermediate layer on the supporting layer, and finally depositing the bottom layer on the intermediate layer. Since the gel top coat layer is quite thin and thus susceptible to puncture, deformation, and other damage, the supporting layer must be free of voids, air-pockets, and the like. However, the fiber glass filled thermosettable polyester supporting layer, as deposited by spraying, generally may not be free of voids, air pockets, and the like. These imperfections must be removed from the polyester resin before the thermosettable polyester resin is cured. A roller may be used to pass over the glass-filled thermosettable polyester deposit to remove any voids, airholes, and the like present therein. However, this is a rather time consuming and labor intensive procedure, particularly if the composite article is of a complex shape or form.

Each tub or shower has a drain in a drain area that must be of sufficient strength to support a user. Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the requirements is approved for use in homes, buildings or other structures as a plumbing fixture.

SUMMARY

According to an embodiment described herein, a bathing vessel has a bottom, and a drain disposed in the bottom adjacent a blended area that is disposed between the side wall and the bottom. The side wall, the bottom wall, and the blended area are constructed of a a-sandwich having a first layer of rigid polyurethane material, a second layer of capping material attached to said first layer. The ratio of a density of the polyurethane backing adjacent the drain to a thickness of polyurethane backing is between 1-80:1. The side wall, the blended area and the bottom wall flex to absorb loads adjacent the drain.

According to a further embodiment described herein, a bathing vessel has a bottom, a side wall, and a drain disposed in the bottom adjacent a blended area, the blended area disposed between the side wall and the bottom. The side wall, the blended area and the bottom wall are constructed of a sandwich having a first layer of rigid polyurethane material and a second layer of capping material attached to the first layer. The blended area has a first curve extending upwardly towards the side wall, a second curve extending upwardly from and attaching to the first curve and a third curve extending upwardly from and attaching to the second curve and attaching to the side wall.

These and other features of the present invention can be best understood from the following specification and drawings, the following of which is a brief description.

DETAILED DESCRIPTION

Figure 1:
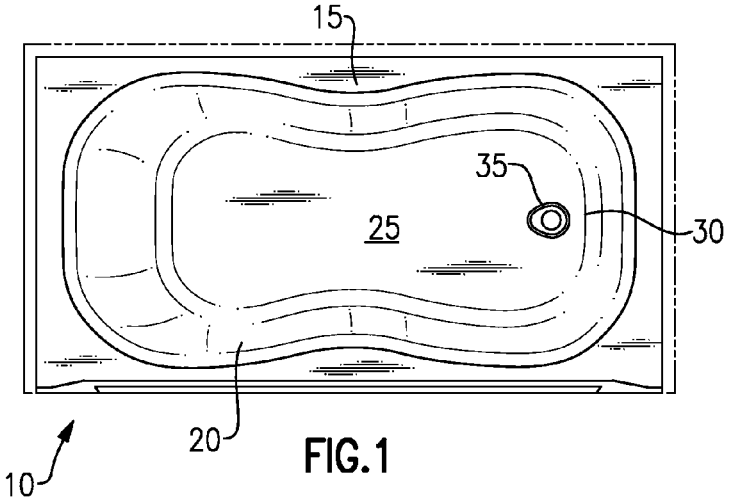
FIG. 1 is a top view of a tub incorporating an embodiment of a drain.

Referring to FIG. 1, a top view of a tub 10 is shown. The tub 10 has ledge 15, a plurality of contoured side walls 20, a bottom 25, and a blended area 30 between a side wall 20 and the bottom 25, and a drain 35.

Figure 2:
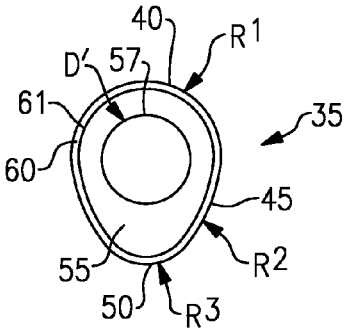
FIG. 2 is a top view of the drain of FIG. 1.

Referring to FIG. 2, description of the drain 35 is shown. The drain 35 has a teardrop shape, and has an upper contour 40 that has a radius R1 of 1.86, a blended side contour 45 that has a radius R2 of 4.05, and a blended lower contour 50 that has a radius R3 of 1.04. A funnel area 55 funnels water down to a drain opening 57, to allow water to flow from the bottom 25 of the contours into the drain opening 57. The drain opening 57 has a diameter D1 of 2.20 inches. An inner contour 61 shadows the shape of the outer contour 40, the blended side contour 45, and the lower contour 50.

Figure 3:
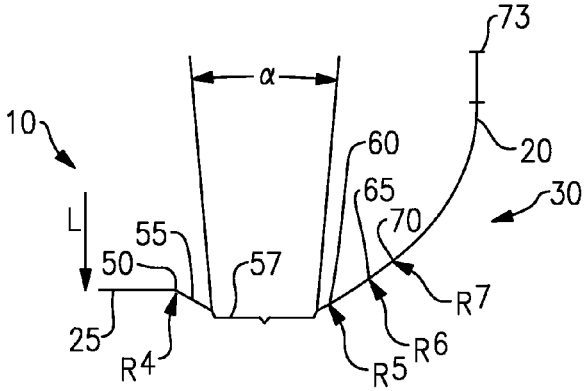
FIG. 3 is a side view partial of a bottom of the tub incorporating the drain of FIG. 2.
Figure 4:
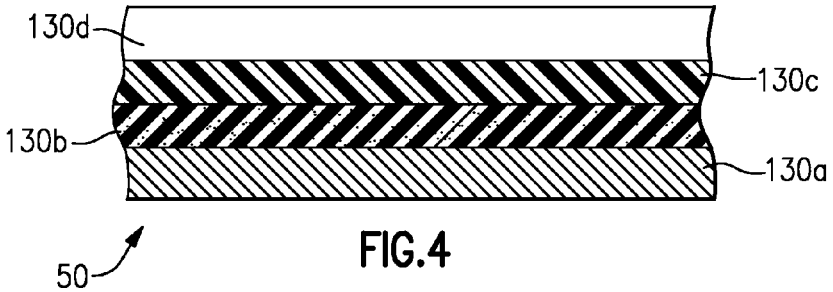
FIG. 4 is a side view of a material used constructing the tub of FIG. 1.

Referring to FIG. 3, a side view partial of the tub 10 of FIG. 1 is shown. An angle $\alpha$ of 10.0° is defined between the inner contour 61 and the outer contour 40 (see also FIG. 2).

Referring back to FIG. 3, the blended area 30 includes a first curve 60 having a radius $R^5$ between about 0.4 and 0.5 with 0.44 preferred, a second curve 65 having a relatively flatter radius $R^6$ between 4 and 6 with about 5 preferred and a third curve 70 having a radius $R^7$ between 0.2 and 0.4 with about 0.3 preferred. A ratio of the radius $R^6$ to the radius $R^5$ is about 30-10/1 with 16.3:1 preferred. The curves are crafted, in conjunction with a construction of the tub 10, to shift and share a load L around the drain 35 up the blended area 30 to the side wall 20. The first curve 60 allows a transition from the bottom 25 of the tub 10 relative to the rest of the tub 10. The second curve 65 is a transition area to move the blended area 30 outwardly from the drain 35 so that the third curve 70 provides a transition to blend and space the second curve to the side wall 20 and to the overflow opening 73. All three curves assist in sharing the load L up the side wall 20. However, the bottom 25 around the drain 35 may be made of a specific material to assist in sharing the load L to assist the curves 60, 65 70 in sharing the load L. Curves having other radii that allow the load L to be shared up the blended area 30 to a side wall 35 are contemplated herein.

The blended area 30 has a layer of acrylic material 130*d* (a capping layer) arranged on a first layer of polyurethane material 130*a*, a layer of acrylonitrile butadiene styrene (ABS) material 130*c* is arranged between the layer of acrylic material 130*d* and the first layer of polyurethane material 130*a*, and a second layer of polyurethane material 130*b* is arranged between the layer of ABS material 130*c* and the first layer of polyurethane material 130*a*. In some examples, additional layers may be arranged among the layers 130*a-d*. The thicknesses of the individual layers 130*a-d* is not necessarily shown to scale and may vary. In embodiments, the ratio of the thickness of the layer of acrylic material 130*d* to the thickness of the layer of ABS material is no greater than 1, to facilitate meeting strength requirements.

The side walls, the bottom wall 25 and the deck 15 are constructed of a top layer 75 which may contact a user and water or the like. The rigid polyurethane foam layer 50 has a density rating between 1.0 pounds per cubic foot and 10.0 pounds per cubic foot and is applied at a thickness between 0.125 inches and 1.000 inches. The PMMA and ABS sheets 130*d* and 130*c* have an overall thickness around the drain 35 between 0.01 inches and 0.3 inches. The ratio of PMMA to ABS in the composition of the top layers 130*d*, 130*c* may be any amount between 0.01-1:1. This construction is rigid but flexible enough to share a load L up through the blended area 30 to the side wall 20 thereby allowing the thickness of the construction about the drain 35 to be thinner relative to the prior art. A ratio between the density of the rigid polyurethane foam layer 130*b* and the thickness of the rigid polyurethane foam layer 130*b* is between 80-1:1.

By providing this sheet with the curve 60, 65, 70 geometries of the blended area 30 loads in the drain 35 may be partially absorbed by the blended area 30 and the side wall 20 contiguous to the drain area. As such, the drain 35 disclosed herein shows strength and rigidity to meet the strength it needs for proper operation, including specific point loads L that may be required.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bathing vessel, said bathing vessel comprising:
a bottom,
a side wall,
a drain disposed in said bottom adjacent a blended area, said blended area disposed between said side wall and said bottom,
wherein said side wall, said blended area and said bottom wall are constructed of a sandwich having
a first layer of rigid polyurethane material,
a second layer of capping material attached to said first layer,
wherein a ratio of a density of said polyurethane backing adjacent said drain to a thickness of polyurethane backing is between 1-80:1 and wherein said side wall, said blended area and said bottom wall flex to absorb loads adjacent said drain.

2. The bathing vessel of claim 1 wherein said blended area further comprises:
a first curve transitioning from said bottom into a second curve wherein said curve spaces said blended area outwardly to blend said blended area into said side wall.

3. The bathing vessel of claim 2 wherein said first curve has a radius that is less than a radius of said second curve.

4. The bathing vessel of claim 2 wherein a ratio between a radius of said first curve and a radius of said second curve is between 30-10:1.

5. The bathing vessel of claim 4 wherein said ratio is 16.3:1.

6. The bathing vessel of claim 2 wherein a third curve connects said second curve to said side wall.

7. The bathing vessel of claim 6 wherein said third curve has a radius that is less than a radius of said second curve.

8. The bathing vessel of claim 1 wherein said blended area is curved.

9. The bathing vessel of claim 8 wherein said curved blended area has a first curve attaching to said bottom, a second curve attaching to said first curve and a third curve attaching to said second curve and to said side wall wherein each of said three curves have different radii than the other curves.

10. The bathing vessel of claim 1 wherein said capping layer has an overall thickness around said drain between 0.01 inches and 0.3 inches.

11. The bathing vessel of claim 10 wherein said capping layer comprises a PMMA layer and an ABS layer.

12. The bathing vessel of claim 11 wherein a ratio between a thickness of said PMMA layer and said ABS layer is from 0.01-1:1.

13. The bathing vessel of claim 1 wherein said drain has a teardrop shape.

14. The bathing vessel of claim 13 wherein said drain has in inner contour that descends at an angle of about 10°.

15. A bathing vessel, said bathing vessel comprising:
a bottom,
a side wall,
a drain disposed in said bottom adjacent a blended area, said blended area disposed between said side wall and said bottom,
wherein said side wall, said blended area and said bottom wall are constructed of a sandwich having
a first layer of rigid polyurethane material,
a second layer of capping material attached to said first layer, and
wherein said blended area has a first curve extending upwardly towards said side wall, a second curve extending upwardly from and attaching to said first curve and a third curve extending upwardly from and attaching to said second curve and attaching to said side wall.

16. The bathing vessel of claim 15 wherein said first curve has a radius of between 0.4-0.5.

17. The bathing vessel of claim 15 wherein said second curve has a radius of between 4-6.

18. The bathing vessel of claim 15 wherein said third curve has a radius of between 0.2 and 0.4.

19. The bathing vessel of claim 15 wherein a ratio between a radius of said first curve and a radius of said second curve is between 0.67-.0.12:1.

20. The bathing vessel of claim 15 wherein a ratio between a radius of said first curve and a radius of said third curve is between 2.5-1:1.

21. The bathing vessel of claim 15 wherein a ratio between a radius of said second curve and a radius of said third curve is between 10-30:1.

* * * * *